US012227912B1

(12) United States Patent
Zhang et al.

(10) Patent No.: US 12,227,912 B1
(45) Date of Patent: Feb. 18, 2025

(54) PILE-NET FLEXIBLE CABLE BARRIER STRUCTURE AND CONSTRUCTION METHOD THEREOF

(71) Applicant: Railway Construction Research Institute, China Academy of Railway Science Group Co., Ltd., Beijing (CN)

(72) Inventors: Yufang Zhang, Beijing (CN); Junli Wan, Beijing (CN); Kun Yuan, Beijing (CN); Jian Li, Beijing (CN); Wenjiao Zhou, Beijing (CN); Mingchang Hei, Beijing (CN); Guozhuang Song, Beijing (CN); Zhongming Yang, Beijing (CN); Xu Gao, Beijing (CN); Zhenhua Yin, Beijing (CN); Jiawei Fan, Beijing (CN); Bo Liu, Beijing (CN); Jian Cui, Beijing (CN)

(73) Assignee: Railway Construction Research Institute, China Academy of Railway Science Group Co., Ltd., Beijing (CN)

( * ) Notice: Subject to any disclaimer, the term of this patent is extended or adjusted under 35 U.S.C. 154(b) by 0 days.

(21) Appl. No.: 18/776,265

(22) Filed: Jul. 18, 2024

(30) Foreign Application Priority Data

Oct. 10, 2023 (CN) ..... 202311301266.5

(51) Int. Cl.
*E01F 7/04* (2006.01)

(52) U.S. Cl.
CPC ..... *E01F 7/045* (2013.01)

(58) Field of Classification Search
CPC ..... E01F 7/00; E01F 7/02; E01F 7/025; E01F 7/04; E01F 7/045
USPC ..... 256/12.5, 13.1, 14
See application file for complete search history.

(56) References Cited

U.S. PATENT DOCUMENTS

| | | | | |
|---|---|---|---|---|
| 6,592,103 | B2 * | 7/2003 | Sennhauser | E01F 7/045 256/45 |
| 12,084,821 | B2 * | 9/2024 | Liu | E01F 7/025 |
| 2024/0035241 | A1 * | 2/2024 | Bichler | E01F 7/04 |

FOREIGN PATENT DOCUMENTS

| | | | | |
|---|---|---|---|---|
| DE | 202013103524 | U1 * | 10/2013 | E01F 7/045 |
| EP | 1500747 | A1 * | 1/2005 | E01F 7/045 |
| EP | 1921210 | A1 * | 5/2008 | E01F 7/04 |
| WO | WO-2015052745 | A1 * | 4/2015 | E01F 7/04 |

* cited by examiner

*Primary Examiner* — Josh Skroupa

(57) ABSTRACT

A pile-net flexible cable barrier structure includes a first V-shaped pile, a second V-shaped pile, a left tension pile, a right tension pile, a first flexible cable net disposed between the left tension pile and the first V-shaped pile, a second flexible cable net disposed between the first V-shaped pile and the second V-shaped pile, and a third flexible cable net disposed between the second V-shaped pile and the right tension pile. A second pile body of the first V-shaped pile are disposed parallel to a third pile body of the second V-shaped pile, openings of the first V-shaped pile and the second V-shaped pile face a same side, the left tension pile are disposed parallel to the first pile body of the first V-shaped pile, and the right tension pile are disposed parallel to the fourth pile body of the second V-shaped pile.

4 Claims, 2 Drawing Sheets

PILE-NET FLEXIBLE CABLE BARRIER STRUCTURE AND CONSTRUCTION METHOD THEREOF

CROSS-REFERENCE TO RELATED APPLICATION

This application claims priority to Chinese Patent Application No. 202311301266.5, filed Oct. 10, 2023, which is herein incorporated by reference in its entirety.

TECHNICAL FIELD

The disclosure relates to the field of support technologies of dangerous rock at slope, and more particularly to a pile-net flexible cable barrier structure and its construction method.

BACKGROUND

A flexible protection net is an important slope protection technology in the field of slope geological hazards. A passive flexible protection net structure can achieve interception tasks under different rock impact systems from low energy level to high energy level (250 kilojoule, kJ-8000 kJ) according to protection needs. The passive flexible protection net is installed on slopes of railways or highways by using fixed methods such as anchor rods, steel piles, support ropes, and tension anchor ropes. When falling rocks impact a protective system, impact energy is mainly dissipated by the protection net and an energy dissipation device, and residual energy is absorbed by a load-bearing matrix.

The passive flexible protection net structure in the related art mainly includes steel columns, upper and lower support ropes, anchor rods, tension anchor ropes, woven circular nets, double twisted hexagonal nets, consumption devices, and shackles. The steel columns include a middle steel column and side steel columns. The upper support rope and the lower support rope pass through the middle steel column from one of the side steel columns and are fixed to another of the side steel columns. The woven circular nets or double twisted hexagonal nets are arranged between the upper support rope and the lower support rope. Two ends of the upper support rope and the lower support rope are anchored in the slope through anchor cables, and the side steel columns are anchored into the slope by lateral anchor cables.

Above structural form has a good applicability effect for slope protection where potential energy of dangerous rocks is low, rolling kinetic energy is small, and a slope surface is gentle. However, when the potential energy of the dangerous rocks is high, the slope surface is steep, and the rolling kinetic energy is large, the middle steel column and the side steel columns are prone to bending and damage under repeated impact of the falling rocks for a long time. The side steel columns undergo lateral deformation towards the middle steel column under traction of the upper and lower support ropes, and an edge of the flexible protection net structure is opened, resulting in a failure of rock interception.

SUMMARY

In order to solve above problems, the disclosure provides a pile-net flexible cable barrier structure with a high-energy level and its construction method, the pile-net flexible cable barrier structure with the high-energy level has advantages of strong tensile and pull-out energy. Meanwhile, the pile-net flexible cable barrier structure eliminates a side support column structure and uses multiple tensioning plates to replace it without needs to anchor two ends of upper and lower support cables. A side tensile strength of the pile-net flexible cable barrier structure is stronger, and protection nets of the pile-net flexible cable barrier structure is woven from the upper support cables, the lower support cables, and vertical cables. A tensile strength of the protection nets is strong, more kinetic energy is consumed through hard contact and tensile deformation of V-shaped piles is reduced.

To achieve above technical effects, the disclosure has following technical solutions.

The pile-net flexible cable barrier structure includes a first V-shaped pile, a second V-shaped pile, a left tension pile, a right tension pile, a first flexible cable net disposed between the left tension pile and the first V-shaped pile, a second flexible cable net disposed between the first V-shaped pile and the second V-shaped pile, and a third flexible cable net disposed between the second V-shaped pile and the right tension pile.

The first V-shaped pile includes a first pile body and a second pile body, the first pile body and the second pile body together form a V-shaped structure with an angle of 45°, the second V-shaped pile includes a third pile body and a fourth pile body, the third pile body and the fourth pile body together form a V-shaped structure with an angle of 45°, the second pile body of the first V-shaped pile and the third pile body of the second V-shaped pile are disposed parallel to each other, openings defined on the first V-shaped pile and the second V-shaped pile face a same side, the left tension pile and the first pile body of the first V-shaped pile are disposed parallel to each other, and the right tension pile and the fourth pile body of the second V-shaped pile are disposed parallel to each other.

The first flexible cable net, the second flexible cable net and the third flexible cable net are net structures interwoven with horizontal cables and vertical cables, the horizontal cables of each of the first flexible cable net, the second flexible cable net and the third flexible cable net include an upper cable, a lower cable and intermediate cables, an end of each horizontal cable of the first flexible cable net is anchored at the first pile body, another end of each horizontal cable of the first flexible cable net is anchored at the left tension pile, an end of each horizontal cable of the third flexible cable net is anchored at the fourth pile body, and another end of each horizontal cable of the third flexible cable net is anchored at the right tension pile.

Each of the left tension pile and the right tension pile includes multiple rectangular blocks arranged in a vertical manner, the horizontal cables of the first flexible cable net are anchored in a one-to-one mapping manner (i.e., in a one-to-one correspondence manner) at the rectangular blocks of the left tension pile, and the horizontal cables of the third flexible cable net are anchored in a one-to-one mapping manner at the rectangular blocks of the right tension pile.

In an embodiment, the left tension pile and the right tension pile are configured to be fixed at a 450 angle into a left mountain body and a right mountain body, respectively. Two ends of each horizontal cable of the first flexible cable net are fixed to the left tension pile and the first V-shaped pile by anchoring tools, respectively. Two ends of each horizontal cable of the second flexible cable net are fixed to the first V-shaped pile and the second V-shaped pile by anchoring tools, respectively. Two ends of each horizontal cable of the third flexible cable net are fixed to the second V-shaped pile and the right tension pile by anchoring tools, respectively.

In an embodiment, each anchoring tool includes a plate and an anchor device, and each horizontal cable is a prestressed steel strand.

In an embodiment, the first V-shaped pile, the second V-shaped pile, the left tension pile and the right tension pile are reinforced concrete structures.

The construction method of the pile-net flexible cable barrier structure includes following steps.

S1, construction of the first V-shaped pile and the second V-shaped pile: a spiral drilling rig drills holes, V-shaped steel rebar cages are placed into the holes respectively, and concrete is cast. The step that concrete is cast includes: underground sections are cast with the concrete, and when the concrete cast into the underground sections reaches a designed strength, above-ground sections are supported with formworks and are cast with the concrete to obtain the first V-shaped pile and the second V-shaped pile. Holes for prestressed steel strands are reserved when casting the above-ground sections.

S2, construction of the left tension pile and the right tension pile: rectangular holes are drilled manually on mountain bodies at two sides of a tunnel entrance and exit, rectangular rebar cages are inserted into the rectangular holes and then cast with concrete, and holes for prestressed steel strands are reserved when casting the concrete.

S3, construction of flexible cable nets (i.e., the first flexible cable net, the second flexible cable net and the third flexible cable net): the horizontal cables are fixed between the left tension pile and the first V-shaped pile, the first V-shaped pile and the second V-shaped pile, as well as the second V-shaped pile and the right tension pile through the anchoring tools, and after fixing the horizontal cables, the vertical cables are fixed perpendicularly on the horizontal cables to form the flexible cable nets.

The disclosure has the following beneficial effects: The pile-net flexible cable barrier structure with the high-energy level has the advantages of strong tensile and pull-out energy. Meanwhile, the pile-net flexible cable barrier structure eliminates the side support column structure and uses multiple tension piles to replace it without needs to anchor the two ends of the upper and lower support cables. Lateral tension of the flexible cable nets is dispersed through multiple tension piles to improve lateral tension capacity of the pile-net flexible cable barrier structure. The flexible cable nets of the pile-net flexible cable barrier structure are woven from the horizontal cables and the vertical cables. The horizontal cables and the vertical cables are made of steel strands with high deformation resistance and strong tensile capacity. The flexible cable nets consume more kinetic energy through hard contact and reduce tensile deformation of the V-shaped piles. At the same time, the structural form of the disclosure has greater tensile and bending resistance, without a need for traditional anchor cables to improve the tensile strength, thereby greatly saving construction costs and engineering costs.

BRIEF DESCRIPTION OF DRAWINGS

In order to provide a clearer explanation of technical solutions of embodiments of the disclosure, accompanying drawings of the embodiments are described below. It is apparent that the accompanying drawings in the following description are only some embodiments of the disclosure. For those skilled in the art, other accompanying drawings can be obtained based on the accompanying drawings without creative labor.

Figure 1:
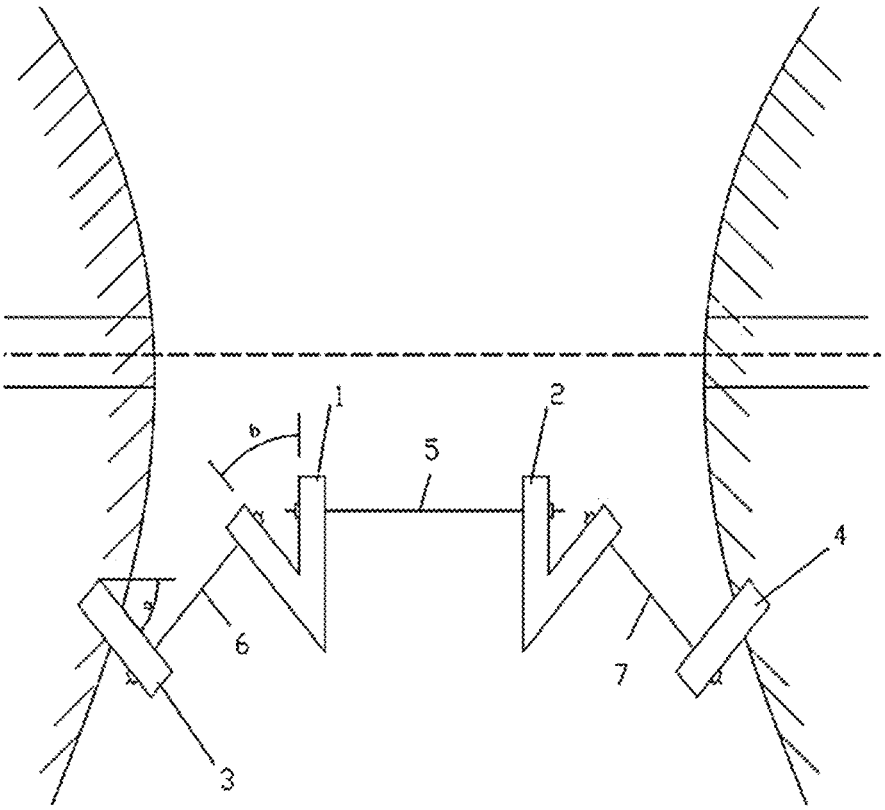
FIG. 1 illustrates a layout plan of a pile-net flexible cable barrier structure with a high-energy level.

Description of reference numerals: 1: first V-shaped pile; 2: second V-shaped pile; 3: left tension pile; 4: right tension pile; 5: second flexible cable net; 6: first flexible cable net; 7: third flexible cable net; 8: anchoring tool; 9: anchoring tool; 10: anchoring tool; 11: first pile body; 12: second pile body; 13: opening; 21: third pile body; 22: fourth pile body; 23: opening; 51: upper cable; 52: lower cable; 53: vertical cable; 54: intermediate cable; 81: plate; 82: anchor device.

DETAILED DESCRIPTION OF EMBODIMENTS

A clear and complete description of the technical solution in the embodiments of the disclosure are provided below, in conjunction with the accompanying drawings. Apparently, the described embodiments are only a part of embodiments of the disclosure, not all of them. Based on the embodiments in the disclosure, all other embodiments obtained by those skilled in the art without creative labor fall within the scope of protection of the disclosure.

Figure 2:
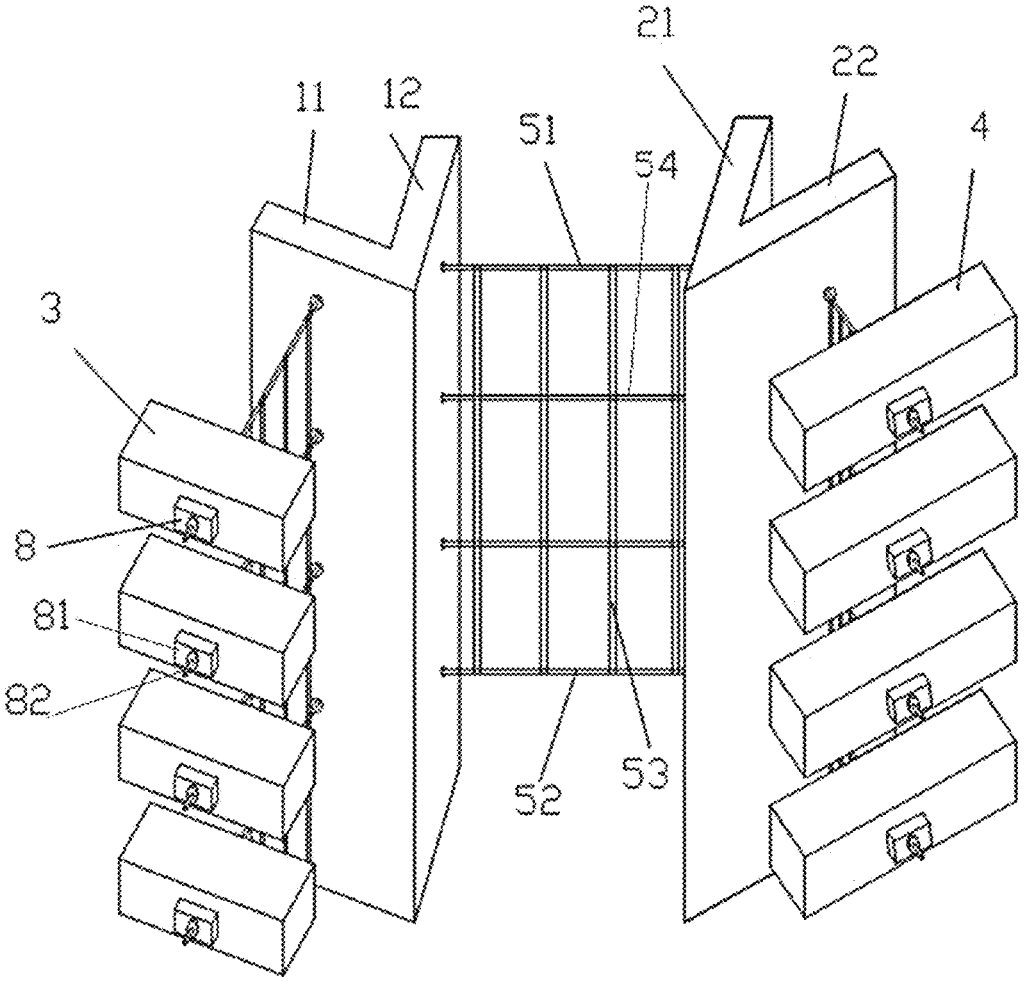
FIG. 2 illustrates a schematic structural diagram of the pile-net flexible cable barrier structure with the high-energy level.

Referring to FIG. 1 and FIG. 2, a pile-net flexible cable barrier structure includes a first V-shaped pile 1, a second V-shaped pile 2, a left tension pile 3, a right tension pile 4, a first flexible cable net 6 disposed between the left tension pile 3 and the first V-shaped pile 1, a second flexible cable net 5 disposed between the first V-shaped pile 1 and the second V-shaped pile 2, and a third flexible cable net 7 disposed between the second V-shaped pile 2 and the right tension pile 4.

The first V-shaped pile 1 includes a first pile body 11 and a second pile body 12, the first pile body 11 and the second pile body 12 together form a V-shaped structure with an angle of 45°, the second V-shaped pile 2 includes a third pile body 21 and a fourth pile body 22, the third pile body 21 and the fourth pile body 22 together form a V-shaped structure with an angle of 45°, the second pile body 12 of the first V-shaped pile 1 and the third pile body 21 of the second V-shaped pile 2 are disposed parallel to each other, an opening 13 defined on the first V-shaped pile 1 and an opening 23 defined on the second V-shaped pile 2 face a same side, the left tension pile 3 and the first pile body 11 of the first V-shaped pile 1 are disposed parallel to each other, and the right tension pile 4 and the fourth pile body 22 of the second V-shaped pile 2 are disposed parallel to each other.

The first flexible cable net 6, the second flexible cable net 5 and the third flexible cable net 7 are net structures interwoven with horizontal cables and vertical cables 53, the horizontal cables of each of the first flexible cable net, the second flexible cable net and the third flexible cable net include an upper cable 51, a lower cable 52 and intermediate cables 54, an end of each horizontal cable of the first flexible cable net 6 is anchored at the first pile body 11, another end of each horizontal cable of the first flexible cable net 6 is anchored at the left tension pile 3, an end of each horizontal cable of the third flexible cable net 7 is anchored at the fourth pile body 22, and another end of each horizontal cable of the third flexible cable net 7 is anchored at the right tension pile 4.

Each of the left tension pile 3 and the right tension pile 4 includes multiple rectangular blocks arranged in a vertical manner, the horizontal cables of the first flexible cable net 6 are anchored in a one-to-one mapping manner at the rectangular blocks of the left tension pile 3, and the horizontal cables of the third flexible cable net 7 are anchored in a one-to-one mapping manner at the rectangular blocks of the right tension pile 4.

In the embodiment, the left tension pile 3 and the right tension pile 4 are configured to be fixed at a 450 angle into a left mountain body and a right mountain body, respectively. Two ends of each horizontal cable of the first flexible cable net 6 are fixed to the left tension pile 3 and the first V-shaped pile 1 by anchoring tools 8, respectively. Two ends of each horizontal cable of the second flexible cable net 5 are fixed to the first V-shaped pile 1 and the second V-shaped pile 2 by anchoring tools 9, respectively. Two ends of each horizontal cable of the third flexible cable net 7 are fixed to the second V-shaped pile 2 and the right tension pile 4 by anchoring tools 10, respectively.

In the embodiment, each of the anchoring tools 8, the anchoring tools 9 and the anchoring tools 10 includes a plate 81 and an anchor device 82, and each horizontal cable is a prestressed steel strand.

In the embodiment, the first V-shaped pile 1, the second V-shaped pile 2, the left tension pile 3 and the right tension pile 4 are reinforced concrete structures.

The construction method of the pile-net flexible cable barrier structure includes following steps.

S1, construction of the first V-shaped pile 1 and the second V-shaped pile 2: a spiral drilling rig drills holes, V-shaped steel rebar cages are placed into the holes respectively, and concrete is cast. The step that concrete is cast includes: underground sections are cast with the concrete, and when the concrete cast into the underground sections reaches a designed strength, above-ground sections are supported with formworks and are cast with the concrete to obtain the first V-shaped pile 1 and the second V-shaped pile 2. Holes for prestressed steel strands are reserved when casting the above-ground sections.

S2, construction of the left tension pile 3 and the right tension pile 4: rectangular holes are drilled manually on mountain bodies at two sides of a tunnel entrance and exit, rectangular rebar cages are inserted into the rectangular holes and then cast with concrete, and holes for prestressed steel strands are reserved when casting the concrete.

S3, construction of flexible cable nets (i.e., the first flexible cable net 6, the second flexible cable net 5 and the third flexible cable net 7): the horizontal cables are fixed between the left tension pile 3 and the first V-shaped pile 1 through the anchoring tools 8, the first V-shaped pile 1 and the second V-shaped pile 2 through the anchoring tools 9, as well as the second V-shaped pile 2 and the right tension pile 4 through the anchoring tools 10, and after fixing the horizontal cables, the vertical cables 53 are fixed perpendicularly on the horizontal cables to form the flexible cable nets.

A working mechanism of the disclosure is below: when dangerous rocks roll down from a slope and collide with the second flexible cable net 5, the second flexible cable net 5 transfers tensile force to the first V-shaped pile 1 and the second V-shaped pile 2 at the two ends of the second flexible cable net 5, individually. The first V-shaped pile 1 and the second V-shaped pile 2 bear the tensile force from the second flexible cable net 5, individually. Cross-sectional moment of inertia of the first V-shaped pile 1 and the second V-shaped pile 2 is much greater than that of a pile body with a rectangular cross-section due to the V-shaped structures of the first V-shaped pile 1 and the second V-shaped pile 2 of the disclosure, and thus horizontal tensile and bending resistance of the first V-shaped pile 1 and the second V-shaped pile 2 are greatly improved. By improving a structural form, tensile and bending resistance of the overall protection structure can be improved, which can greatly save project costs without a need for traditional anchor cable structures.

Figure 3:
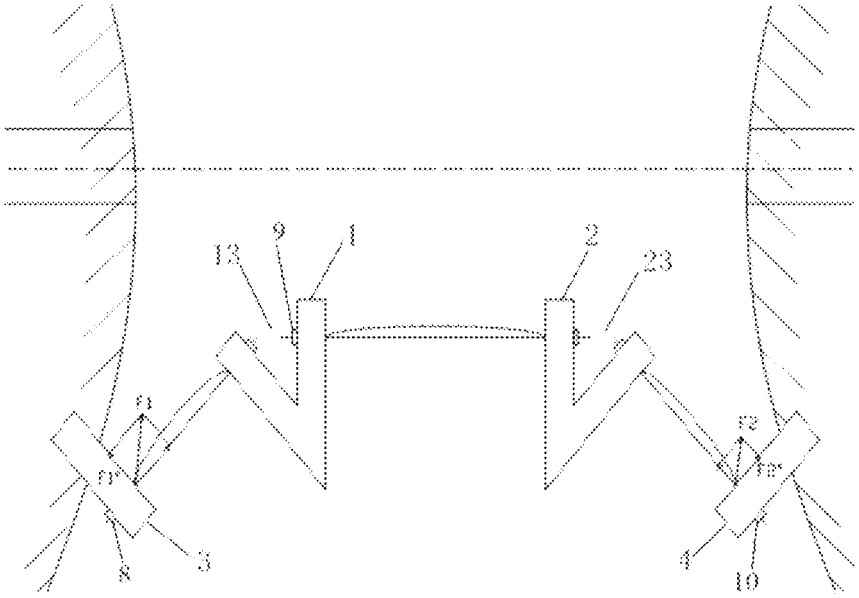
FIG. 3 illustrates a local force analysis diagram of the pile-net flexible cable barrier structure with the high-energy level.

Referring to FIG. 3, the left tension pile 3 and the right tension pile 4 are respectively embedded in the left and right mountain body, the first flexible cable net 6 and the third flexible cable net 7 disperse and transfer tension (i.e., tensile force) to the rectangular blocks of the left tension pile 3 and the right tension pile 4 when subjected to kinetic energy of dangerous rock rolling impact, thereby achieving a purpose of dispersing the tension. By dispersing and transmitting the tension, the left tension pile 3 or the right tension pile 4 are prevented from being damaged due to concentrated transmission of the tension, thereby preventing damage to the flexible cable nets and improving service life of the flexible cable nets. Due to the impact of rolling rocks on the first flexible cable net 6 and the third flexible cable net 7, the first flexible cable net 6 undergoes deformation and generates diagonal tension F1. Component force F1' of the diagonal tension F1 presses the left tension pile 3 into the left mountain body, which can prevent the left tension pile 3 from being pulled out of the left mountain body. Similarly, the third flexible cable net 7 generates diagonal tension F2, and component force F2' of the diagonal tension F2 presses the right tension pile 4 into the right mountain body, preventing the right tension pile 4 from being pulled out of the right mountain body, thereby providing overall anti pulling ability.

In the description of this specification, reference terms such as "one embodiment," "example," "specific example," etc. mean that specific features, structures, materials, or characteristics described in conjunction with the embodiment or example are included in at least one embodiment or example of the disclosure. In the specification, illustrative expressions of the above terms may not necessarily refer to the same embodiments or examples. Moreover, the specific features, structures, materials, or characteristics described can be combined in an appropriate manner in any one or more embodiments or examples.

What is claimed is:

1. A pile-net flexible cable barrier structure, comprising:

a first V-shaped pile, a second V-shaped pile, a left tension pile, a right tension pile, a first flexible cable net disposed between the left tension pile and the first V-shaped pile, a second flexible cable net disposed between the first V-shaped pile and the second V-shaped pile, and a third flexible cable net disposed between the second V-shaped pile and the right tension pile;

wherein the first V-shaped pile comprises a first pile body and a second pile body, the first pile body and the second pile body together form a V-shaped structure with an angle of 45°, the second V-shaped pile comprises a third pile body and a fourth pile body, the third pile body and the fourth pile body together form a V-shaped structure with an angle of 45°, the second pile body of the first V-shaped pile and the third pile body of the second V-shaped pile are disposed parallel to each other, openings defined on the first V-shaped pile and the second V-shaped pile face a same side, the left tension pile and the first pile body of the first V-shaped pile are disposed parallel to each other, and the right tension pile and the fourth pile body of the second V-shaped pile are disposed parallel to each other;

wherein the first flexible cable net, the second flexible cable net and the third flexible cable net are net structures interwoven with horizontal cables and vertical cables, the horizontal cables of each of the first flexible cable net, the second flexible cable net and the third flexible cable net comprise an upper cable, a lower cable and intermediate cables, an end of each horizontal cable of the first flexible cable net is anchored at the first pile body, another end of each horizontal cable of the first flexible cable net is anchored at the left tension pile, an end of each horizontal cable of the third flexible cable net is anchored at the fourth pile body, and another end of each horizontal cable of the third flexible cable net is anchored at the right tension pile;

wherein each of the left tension pile and the right tension pile comprises a plurality of rectangular blocks arranged in a vertical manner, the horizontal cables of the first flexible cable net are anchored in a one-to-one mapping manner at the plurality of rectangular blocks of the left tension pile, and the horizontal cables of the third flexible cable net are anchored in a one-to-one mapping manner at the plurality of rectangular blocks of the right tension pile;

wherein the left tension pile and the right tension pile are configured to be fixed at a 45° angle into a left mountain body and a right mountain body, respectively; two ends of each horizontal cable of the first flexible cable net are fixed to the left tension pile and the first V-shaped pile by anchoring tools, respectively; two ends of each horizontal cable of the second flexible cable net are fixed to the first V-shaped pile and the second V-shaped pile by anchoring tools, respectively; and two ends of each horizontal cable of the third flexible cable net are fixed to the second V-shaped pile and the right tension pile by anchoring tools, respectively.

2. The pile-net flexible cable barrier structure as claimed in claim 1, wherein each anchoring tool comprises a plate and an anchor device, and each horizontal cable is a prestressed steel strand.

3. The pile-net flexible cable barrier structure as claimed in claim 1, wherein the first V-shaped pile, the second V-shaped pile, the left tension pile and the right tension pile are reinforced concrete structures.

4. A construction method of the pile-net flexible cable barrier structure as claimed in claim 1, comprising following steps:

S1, construction of the first V-shaped pile and the second V-shaped pile: drilling holes by a spiral drilling rig, placing V-shaped steel rebar cages into the holes respectively, and casting concrete; wherein the casting concrete comprises:

casting underground sections with the concrete; and when the concrete casted into the underground sections reaches a designed strength, supporting above-ground sections with formworks and casting the above-ground sections with the concrete to obtain the first V-shaped pile and the second V-shaped pile; wherein holes for prestressed steel strands are reserved when casting the above-ground sections;

S2, construction of the left tension pile and the right tension pile: drilling manually rectangular holes on mountain bodies at two sides of a tunnel entrance and exit; and inserting rectangular rebar cages into the rectangular holes and then casting concrete; wherein holes for prestressed steel strands are reserved when casting the concrete; and S3, construction of flexible cable nets: fixing the horizontal cables between the left tension pile and the first V-shaped pile, the first V-shaped pile and the second V-shaped pile, as well as the second V-shaped pile and the right tension pile through the anchoring tools; and after fixing the horizontal cables, fixing the vertical cables perpendicularly on the horizontal cables to form the flexible cable nets.

* * * * *